US011069492B2

(12) United States Patent
Soldan et al.

(10) Patent No.: US 11,069,492 B2
(45) Date of Patent: Jul. 20, 2021

(54) ROTARY HANDLE CONSTRUCTION OF AN ELECTRICAL SWITCH

(71) Applicant: ABB Schweiz AG, Baden (CH)

(72) Inventors: Juha Soldan, Vaasa (FI); Matti Knuuttila, Vaasa (FI); Mikko Välivainio, Vaasa (FI)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/902,362

(22) Filed: Jun. 16, 2020

(65) Prior Publication Data

US 2020/0312591 A1 Oct. 1, 2020

Related U.S. Application Data

(63) Continuation of application No. PCT/FI2018/050866, filed on Nov. 30, 2018.

(51) Int. Cl.
*H01H 21/30* (2006.01)

(52) U.S. Cl.
CPC ..... *H01H 21/30* (2013.01)

(58) Field of Classification Search
CPC H01H 9/28; H01H 9/20; H01H 21/30; H01H 9/286
USPC ..... 200/43.17, 43.01, 43.11, 43.16, 43.19, 200/43.21, 318, 327, 321
See application file for complete search history.

(56) References Cited

U.S. PATENT DOCUMENTS 5,998,743 A * 12/1999 Unkel ..... H01H 9/282 200/43.11
2006/0278505 A1 12/2006 Low et al.

FOREIGN PATENT DOCUMENTS

EP 0450699 A2 10/1991
FR 3029680 * 6/2016 ..... H01H 9/28
FR 3029680 A1 6/2016

OTHER PUBLICATIONS

Finnish Patent Office, International Search Report issued in corresponding Application No. PCT/FI2018/050866, dated Mar. 7, 2019, 19 pp.

* cited by examiner

*Primary Examiner* — Edwin A. Leon
*Assistant Examiner* — Iman Malakooti
(74) *Attorney, Agent, or Firm* — Taft Stettinius & Hollister LLP

(57) ABSTRACT

The construction includes a rotary handle turnable around a first pivot axis between an open- and a closed-position, a locking latch turnable around a second pivot axis between a locked position and a released position, a fixed bottom ring, a first locking pin movable in the longitudinal direction with the locking latch between a first position in which turning of the rotary handle is allowed and a second position in which turning of the rotary handle is allowed and a second position in which turning of the rotary handle is prevented. A second locking pin is movable between a first position in which turning of the locking latch between a locked-position and a released-position is allowed and a second position in which turning of the locking latch into the locked-position is prevented.

12 Claims, 4 Drawing Sheets

ROTARY HANDLE CONSTRUCTION OF AN ELECTRICAL SWITCH

FIELD

Figure 1:
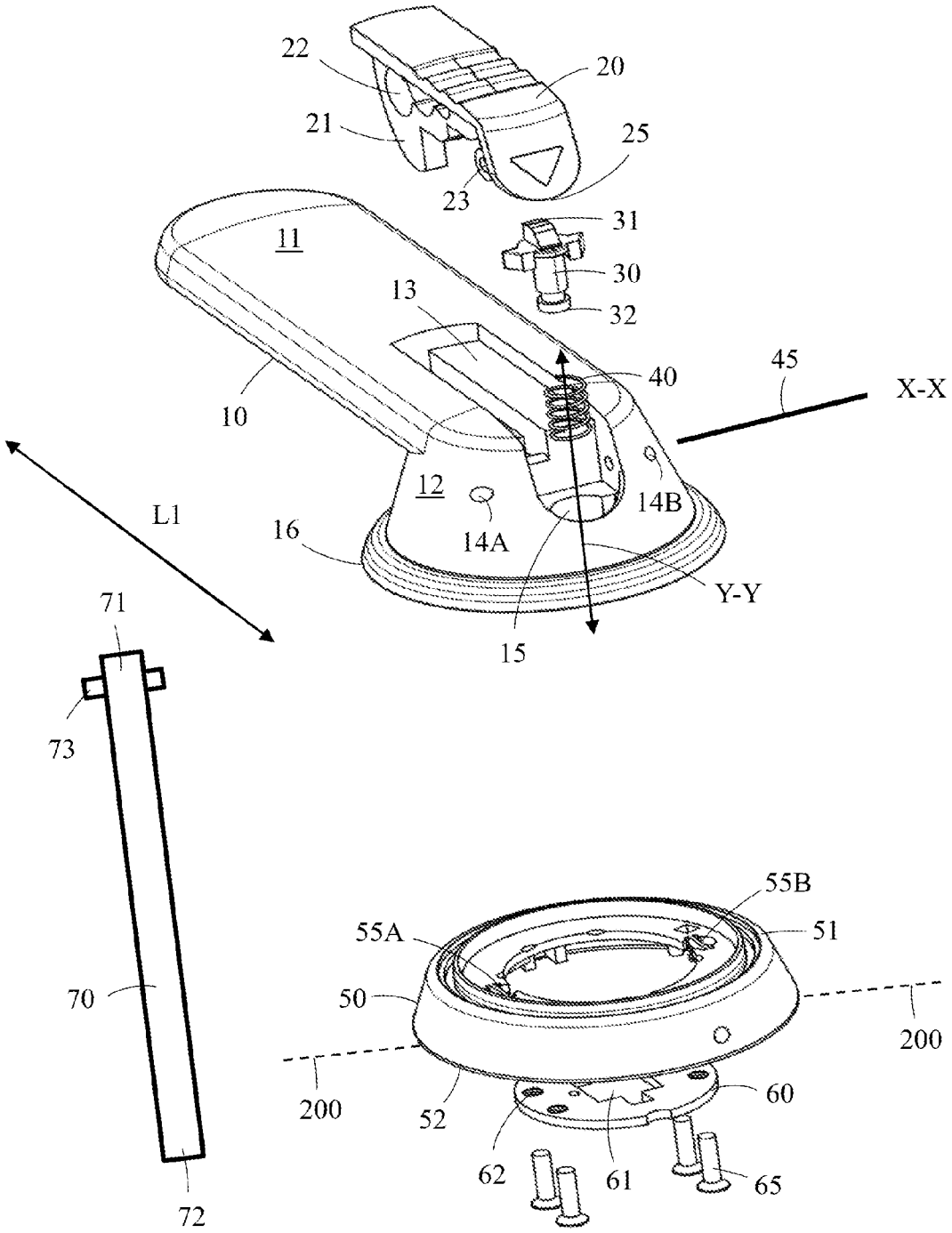

The invention relates to a rotary handle construction of an electrical switch.

BACKGROUND

A switch is an apparatus used for opening and closing of an electric circuit. A switching device may comprise a least one pole operated by a drive device. At least one movable contact may be adapted in the pole, which opens and closes a connection between fixed contacts.

A switching device may be operated with a rotary handle. The rotary handle may be turned between a 0-position in which the switching device opens the electrical circuit and an I-position in which the switching device closes the electrical circuit. The rotary handle may be connected through a drive shaft to the pole of the switching device.

The switching device must be provided with a reliable position indicator and it must further be possible to lock the rotary handle of the switching device in the open-position. The open-position is the position in which the switch opens the electric circuit.

Standards relating to switches require further that locking of the switch in the open-position must be prevented in a situation in which any of the contacts of the switch is not open. In a situation in which at least one of the contacts of the switch is sticking and the rotary handle is turned by force to the 0-position, locking of the rotary handle to this 0-position must be prevented.

SUMMARY

The object of the invention is an improved rotary handle construction of an electrical switch.

The rotary handle construction of an electrical switch according to the invention is defined in claim 1.

The rotary handle construction of the electrical switch comprises:

a rotary handle being turnable around a first pivot axis between at least an open- and a closed-position, a locking latch being adapted into the rotary handle and being turnable around a second pivot axis between a locked-position and a released-position, a bottom ring being fixed in relation to the rotary handle, a first locking pin also being adapted into the rotary handle and being movable in the longitudinal direction with the turning latch between a first position and a second position, in which first position the first locking pin allows turning of the rotary handle in relation to the bottom ring and in which second position the first locking pin prevents turning of the rotary handle in relation to the bottom ring by protruding into a first opening in the bottom ring.

The rotary handle construction is characterized in that a second locking pin is adapted into the rotary handle, said second locking pin being movable in a longitudinal direction between a first position and a second position, in which first position the second locking pin allows turning of the locking latch between the locked-position and the released-position and in which second position the second locking pin prevents turning of the locking latch into the locked-position.

The invention makes it possible to reliably prevent locking of the rotary handle into the open-position in a situation in which at least one of the contacts of the electrical switch is sticking. When the user grips the handle in order to turn the handle into a 0-position (the open-position), the gripping causes at the same time the movement of the second locking pin into its second position, whereby it is not possible to lift the locking latch up into the locked-position. As soon as the user releases his grip from the handle, the second locking pin moves back to its first position, whereby the spring loading of the switch turns the handle back to the I-position (the closed-position). As it is not possible to lift up the locking latch from the rotary handle in such a situation, it is also not possible to attach a padlock to the rotary handle in order to lock the rotary handle into an upper position. The requirements of the standards are thus satisfied.

DRAWINGS

Figure 2:
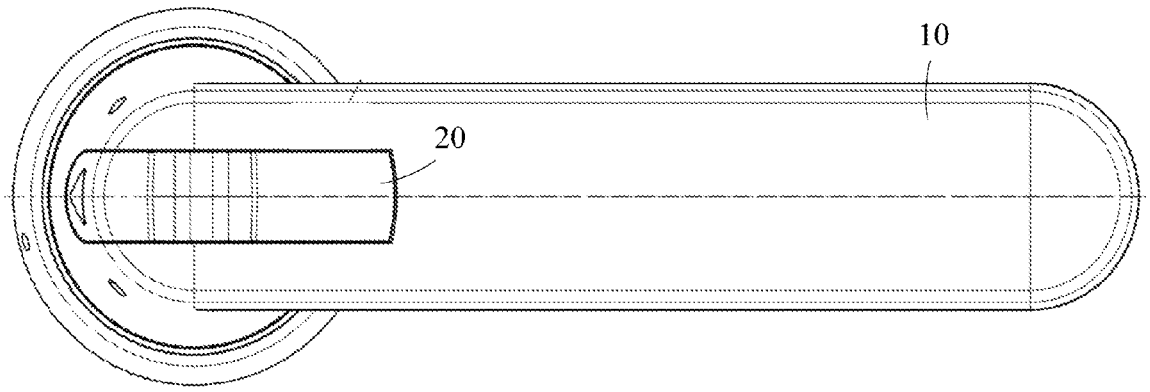
Figure 3:
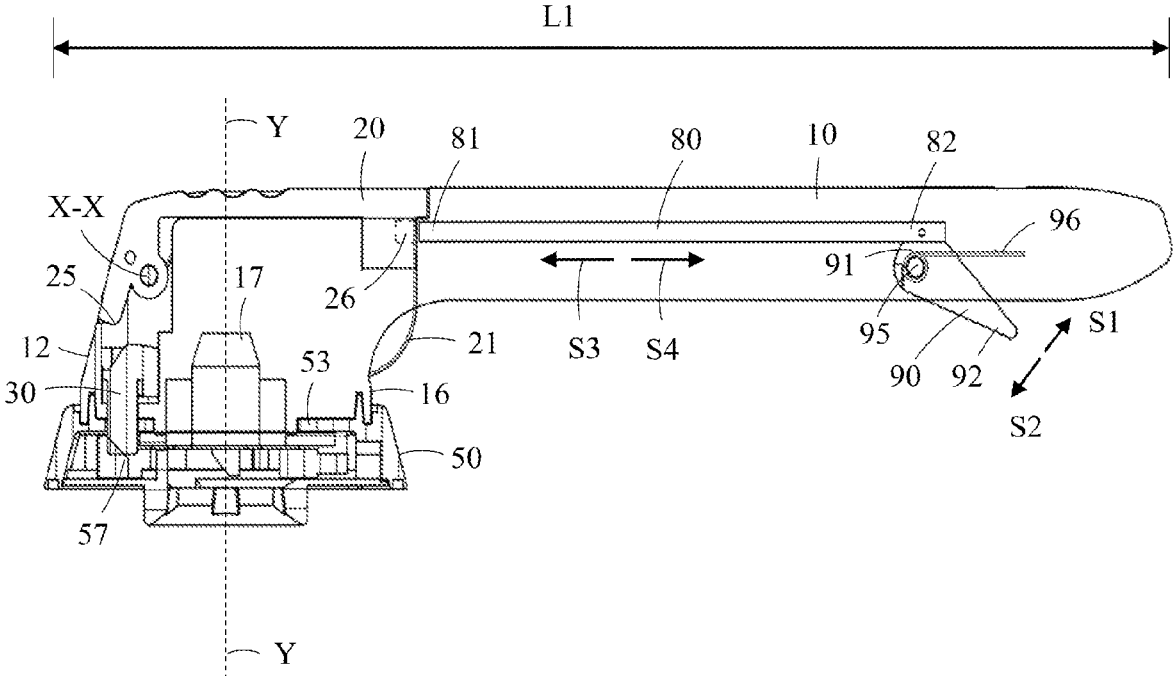
Figure 4:
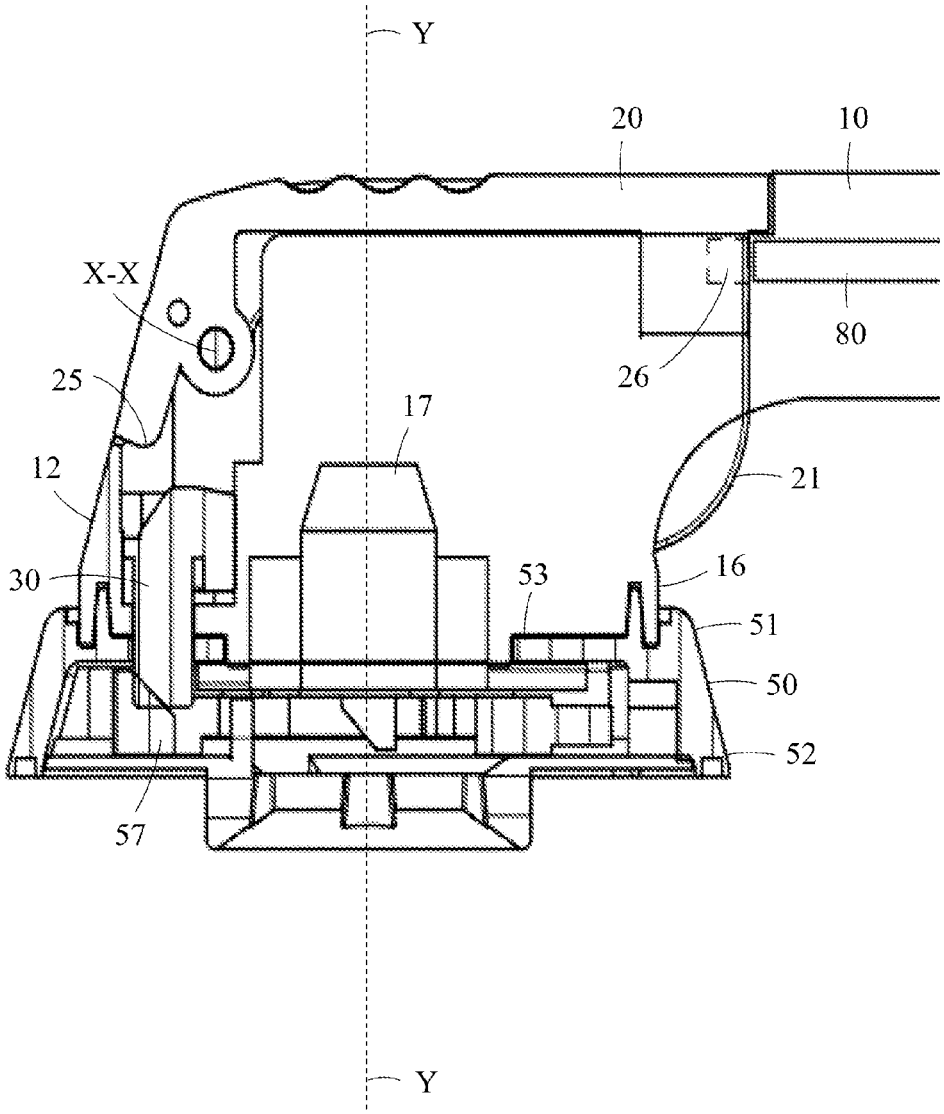
Figure 5:
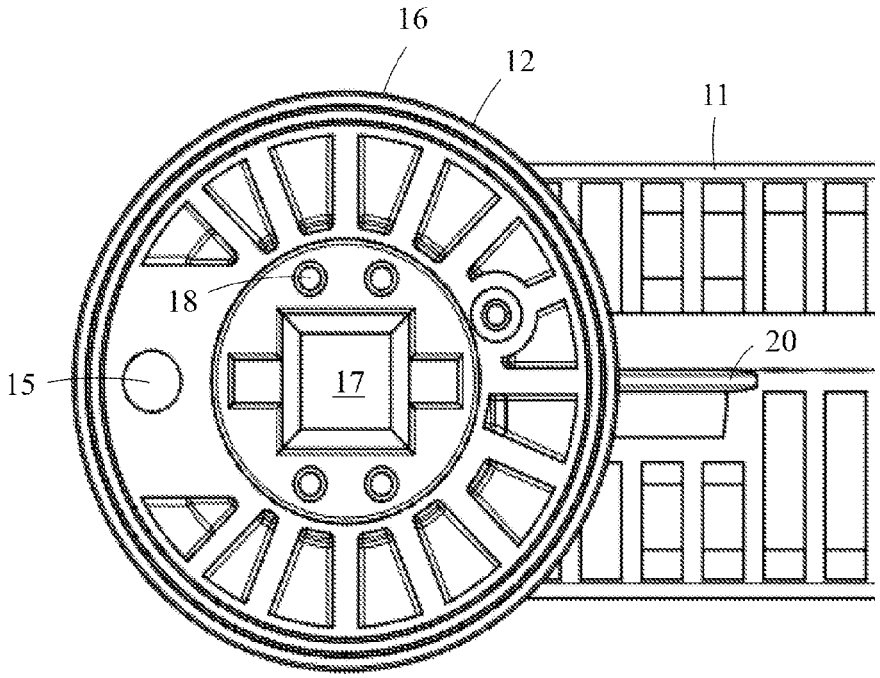
Figure 6:
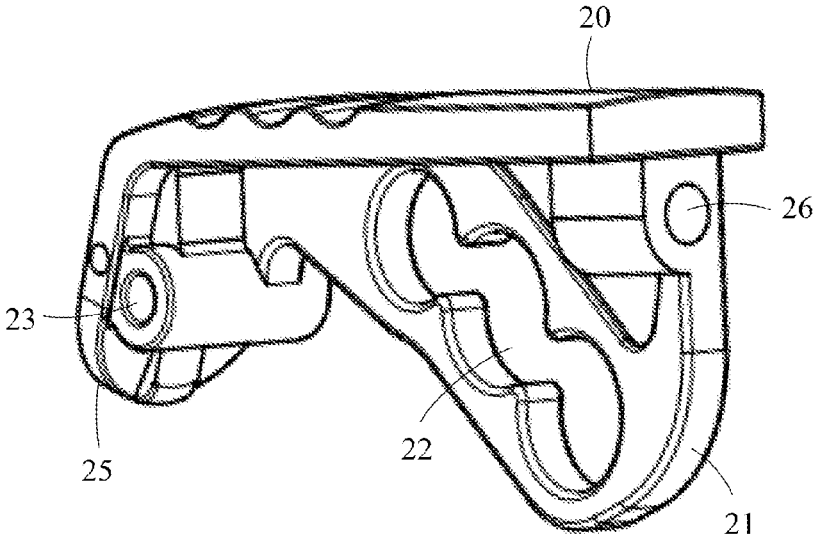

The invention is in the following described with reference to the enclosed figures in which FIG. 1 presents an exploded view of a rotary handle construction of an electrical switch, FIG. 2 presents the rotary handle construction from above, FIG. 3 presents a longitudinal cross section of the rotary handle construction, FIG. 4 presents a longitudinal cross section of the end portion of the rotary handle construction, FIG. 5 presents the end portion of the rotary handle from the bottom, FIG. 6 presents an axonometric view of the locking latch of the rotary handle.

DETAILED DESCRIPTION

FIG. 1 presents an exploded view of a rotary handle construction of an electrical switch.

The rotary handle construction comprises a rotary handle 10, a locking latch 20, a first locking pin 30, a return spring 40, a bottom ring 50, a bottom plate 60 as well as fastening screws 65. The rotary handle construction includes further a drive shaft 70 via which the rotary handle 10 is connected to the electrical switch. The electrical switch is not shown in the figures.

The rotary handle 10 is formed of a gripping portion 11 and an end portion 12. The gripping portion 11 may be formed of a longitudinal piece. The cross section of the gripping portion 11 may be substantially rectangular. The end portion 12 may be substantially annular. The rotary handle 10 is further provided with a longitudinal first space 13 which extends from the gripping portion 11 to the end portion 12. The first space 13 receives the locking latch 20. The longitudinal direction L1 of the rotary handle 10 extends in the longitudinal direction of the gripping portion 11. The rotary handle 10 is turnable around a first pivot shaft Y-Y at least between an open- and a closed-position. A lower portion of the end portion 12 of the rotary handle 10 is provided with a collar 16 which may be substantially annular.

The locking latch 20 is adapted into the first space 13 in the rotary handle 10 so that the locking latch 20 is attached via an articulated joint to the rotary handle 10. The locking latch 20 is provided with a transverse hole 23 and the end portion 12 of the rotary handle 10 is provided with transverse holes 14A, 14B. The first hole 14A extends from an outer surface of the end portion 12 to the first space 13 and the second hole 14B extends from an opposite outer surface of the end portion 12 into the first space 13. The first hole 14A and the second hole 14B are concentric. When the locking latch 20 is positioned in the first space 13, a pivot shaft 45 may be pushed through the holes 14A, 14B in the end portion 12 of the rotary handle 10 and through the hole 23 in the locking latch 20. The pivot shaft 45 forms thus a pivot for the locking latch 20. The locking latch 20 extends in the longitudinal direction L1 of the rotary handle 10. The locking latch 20 may be turned around a second pivot axis X-X formed by the pivot shaft 45 between a locked-position and a released-position. The second pivot axis X-X may extend in a transverse direction of the rotary handle 10. The second pivot axis X-X may extend in a 90 degree angle in relation to the first pivot axis Y-Y.

The locking latch 20 may further comprise a protruding portion 21 which extends downwards in the locking latch 20. This protruding portion 21 comprises an opening 22 extending through the protruding portion 21 in the transverse direction of the locking latch 20. The locking latch 20 forms in the locked-position an angle with the longitudinal L1 direction of the rotary handle 10, whereby the opening 22 of the protruded portion 21 is situated above the upper surface of the gripping portion 11 of the rotary handle 10. The locking latch 20 is in the released-position directed along the longitudinal direction L1 of the rotary handle 10. In the locked-position of the locking latch 20, one or several padlocks may be mounted in the opening 22 in the protruding portion 21 of the locking latch 20, whereby the padlock or the padlocks prevent turning of the locking latch 20 into the released-position. The protruded portion 21 of the locking latch 20 extends through the gripping portion 11 of the rotary handle 10 so that the protruded portion 21 protrudes from an inner surface of the gripping portion 11. The locking latch 20 is provided with an end surface 25 which comes into contact with the first locking pin 30.

The first locking pin 30 is adapted into the first space 13 in the rotary handle 10 i.e. in a hole 15 formed in the end portion 12 of the rotary handle 10, said hole 15 being provided in the first space 13. The hole 15 extends substantially in the direction of the first pivot shaft Y-Y through the end portion 12 of the rotary handle 10. The first locking pin 30 may move in the longitudinal direction of the first locking pin 30 in the hole 15. The first locking pin 30 comprises a first end 31 and a second opposite end 32. The first end 31 of the first locking pin 30 comes into contact with the end surface 25 of the locking latch 20. When the locking latch 20 is lifted upwards from the rotary handle 10, the locking latch 20 turns around the second pivot shaft X-X, whereby the end surface 25 of the locking latch 20 presses the first locking pin 30 downwards.

A return spring 40 is arranged in connection with the first locking pin 30. The return spring 40 may be formed of a coil spring which has been adapted around the first locking pin 30. The hole 15 may be formed of two axially successive portions. The diameter of an upper portion of the hole 15 may be adapted according to an outer diameter of the coil spring 40 and the diameter of a lower portion of the hole 15 may be adapted according to an outer diameter of the first locking pin 30. The coil spring 40 is thus compressed when the end surface 25 of the locking latch 20 moves the first locking pin 30 against the locking-position. The coil spring 40 returns the first locking pin 30 into a released position when no external force is acting on the first locking pin 30 i.e. when the locking latch 20 is released. The first locking pin 30 is thus supported in the hole 15 when the first locking pin 30 moves in its longitudinal direction.

The bottom ring 50 may be fixedly attached with fastening screws 55A, 55B to the fastening surface 200 into which the rotary handle 10 is to be installed. The fastening surface 200 may be formed of a door or sheet in a cubicle. The collar 16 in the lower portion of the end portion 12 of the rotary handle 10 settles against a first end surface 51 of the bottom ring 50. A second end surface 52 of the bottom ring 50 settles against the fastening surface 200. The bottom ring 50 is thus fixed in relation to the rotary handle 10 i.e. the rotary handle 10 turns around the first pivot shaft Y-Y in relation to the bottom ring 50.

The bottom plate 60 acts as a fastening means between the rotary handle 10 and the bottom ring 50. A cross section of the bottom plate 60 may be substantially round. The bottom plate 60 may be attached with fastening screws 65 to the end portion 12 of the rotary handle 10. An outer edge of the bottom plate 60 settles against a support surface within the bottom ring 50 so that the bottom plate 60 may rotate with the rotary handle 10 in relation to the bottom ring 50. The bottom plate 60 comprises a shaft opening 61 in the middle portion of the bottom plate 60, the form of the cross section of the opening 61 corresponding substantially to the form of the cross section of the drive shaft 70. The bottom plate 60 is further provided with fastening openings 62 through which the fastening screws 65 may be conducted.

The drive shaft 70 connects the rotary handle 10 to the control shaft of the electrical switch. Turning of the rotary handle 10 turns thus, via the drive shaft 70, the control shaft provided in the electrical switch. The control shaft may be connected to power transmission elements and working springs in the electrical switch, the working springs acting on the movable contacts of the electrical switch. The drive shaft 70 extends through the bottom plate 60 so that a first end 71 of the drive shaft 70 sets into the end portion 12 of the rotary handle 10 and a second end 72 of the drive shaft 70 sets into the control shaft of the electrical switch. The form of a cross section of the drive shaft 70 may be substantially rectangular. The first end 71 of the drive shaft 70 may further comprise a transverse directed shaft pin 73.

FIG. 2 presents the rotary handle construction from above.

The figure shows that the gripping portion 11 of the rotary handle 10 is formed of a longitudinal substantially rectangular piece having a rounded outer end. The end portion 12 of the rotary handle 10 is formed of a substantially round piece having a collar 16. The locking latch 20 is formed of a longitudinal piece which is seated in the first space 13 formed in the rotary handle 10.

FIG. 3 presents a longitudinal cross section of the rotary handle construction.

The bottom ring 50 is connected from its upper end 51 to the collar 16 in the end portion 12 of the rotary handle 10. The locking latch 20, the pivot shaft X-X of the locking latch 20, the protrusion 21 of the locking latch 20, the end portion 25 of the locking latch 20, and the first locking pin 30 are adapted into the rotary handle 10. The collar 16 of the end portion 12 of the rotary handle 10 is supported on an upper end 51 of the bottom ring 50 and the bottom plate 60 is supported on the support surface 53 of the bottom ring 50. A first opening 57 is provided in the bottom ring 50, into which the lower end 32 of the first locking pin 30 seats when the first locking pin 30 is in the lower position. The bottom plate 60 comprises a shaft opening 61 through which the drive shaft 70 protrudes into the end portion 12 of the rotary handle 10. The first locking pin 30 locks, in the locking position, the rotary handle 10 and the bottom plate 60 to the bottom ring 50. A cavity 17 receiving an upper end 71 of the drive shaft 70 is also provided in the end portion 12 of the rotary handle 10.

The first locking pin 30 is thus movable in its longitudinal direction with the locking latch 20 between the first and the second position. The first locking pin 30 is in the first position at a distance from the bottom ring 50 allowing turning of the rotary handle 10 in relation to the bottom ring 60. The first locking pin 30 protrudes, in the second position, into the first opening 57 in the bottom plate 50 preventing turning of the rotary handle 10 in relation to the bottom ring 50.

The first locking pin 30 is in the first position in the figure, whereby the rotary handle 10 may turn in relation to the bottom ring 50. The first locking pin 30 is, in the first position, in the upper position which also is the released-position.

A lever arm 90 has been adapted in connection with the second end 82 of the second locking pin 80. The lever arm 90 comprises a first end 91 and a second opposite end 92. The lever arm 90 is supported on the rotary handle 10 via a pivot point 95, which is positioned between the first end 91 and the second end 92 of the level arm 90. The shaft of the pivot point 95 extends substantially perpendicular in relation to a longitudinal direction of the second locking pin 80. The level arm 90 may thus be turned around the pivot point 95. The second end 92 of the level arm 90 protrudes from the rotary handle 10. When the user grabs the rotary handle 10 with his hand in order to turn the handle, the user at the same time presses the level arm 90, whereby the level arm 90 turns around the pivot point 95 so that the second end 92 of the level arm 90 is pressed into the rotary handle 10. When the level arm 90 turns in the figure in a counter-clockwise direction S1, the first end 91 of the level arm 90 pushes at the same time the second locking pin 80 to the left S3 in the figure. The first end 81 of the second locking pin 80 is thus positioned in the cavity 26 in the locking latch 20, whereby the locking latch 20 becomes locked. When the user releases his hand from the rotary handle 10, the level arm 90 turns in a clockwise direction S2 to its initial position, in which the second end 92 of the level arm 90 protrudes out from the rotary handle 10. The second locking pin 80 moves thus to the right S4 in the figure so that the first end 81 of the second locking pin 80 exits from the cavity 26 in the locking latch 20, whereby the locking latch 20 is released. A spring means 96 is arranged in connection with the lever arm 90, said spring means 96 returning the second locking pin 80 into the first position when the user releases his grip of the rotary handle 10. The spring means 96 could be positioned in connection with the second locking pin 80 in a corresponding way to the position of the return spring 40 in connection with the first locking pin 30.

The second locking pin 80 is advantageously arranged into the interior of the rotary handle 10. Also the lever arm 90 is advantageously positioned into the interior of the rotary handle 10 so that the second end 92 of the lever arm 90 protrudes out from the rotary handle 10 in a situation in which the user has grabbed the rotary handle 10.

The cross section of the second locking pin 80 may be of any form e.g. it may be round, oval, rectangular, or it may have a trapeze form or it may be polygonal.

FIG. 4 presents a transverse cross section of the end portion of the rotary handle construction.

The bottom ring 50 is connected from its upper end 51 to the collar 16 of the end portion 12 of the rotary handle 10. The locking latch 20 is adapted into the rotary handle 10, which is turnable around the pivot point X-X. The upper end 51 of the bottom ring 50 is adapted to the collar 16 in the end portion 12 and the lower end 52 of the bottom ring 50 is provided with an opening through which the bottom plate 60 may be pushed into the end portion 12. The bottom plate 60 is provided with a shaft opening 61 through which the drive shaft 70 may be pushed into the end portion 12 of the rotary handle 10. The bottom ring 50 comprises a support surface 53 against which the bottom plate 60 may seat. The bottom plate 60 may turn in relation to the bottom ring 50 along the support surface 53 of the bottom ring 50. A cavity 17 receiving the upper end 71 of the drive shaft 70 has also been arranged in the end portion 12 of the rotary handle 10.

FIG. 5 presents the end portion of the rotary handle from the bottom.

The figure does not show the bottom ring 50 and not the bottom plate 60. The cavity 17 into which the upper end 71 of the drive shaft 70 seats is seen in the end portion 12 of the rotary handle 10. Fastening openings 18 are further seen on both sides of the cavity 17 into which fastening openings 18 the fastening screws 65 of the bottom plate 60 seat when the bottom plate 60 is attached to the end portion 12 of the rotary handle 10. A hole 15 is further seen in the end portion 12 of the rotary handle 10 through which hole 15 the first locking pin 30 extends.

FIG. 6 presents and axonometric view of the locking latch of the rotary handle.

The locking latch 20 comprises a transverse hole 23 through which a shaft 45 extends and forms a pivot joint between the locking latch 20 and the rotary handle 10. The locking latch 20 comprises further a protruding portion 21, which extends downward in the locking latch 20. This protruded portion 21 comprises a transverse opening 22 passing through the protruded portion 21. One or several padlocks may be attached to this opening 22. The locking latch 20 comprises an end surface 25, which comes into contact with the upper end 31 of the first locking pin 30. The locking latch 20 comprises further a cavity 26 into which the second locking pin 80 protrudes when the user grabs the rotary handle 10.

In the embodiment shown in the figure, a lever arm 90 is used to move the second locking pin 80 in its 80 longitudinal direction. Instead of the lever arm 90, a press bottom protruding out from the rotary handle 10 could be used. The path of the press bottom would thus be perpendicular to the direction of movement of the second locking pin 80. A power transmission apparatus is in such case needed between the press bottom and the second locking pin 80. The press bottom could be provided with teeth and the second locking pin 80 could also be provided with teeth. These two perpendicular in relation to each other moving teeth could be connected to each other with a cogwheel supported with a pivot point on the rotary handle 10. When the user grabs the rotary handle 10, he simultaneously presses the press bottom into the rotary handle 10, whereby the second locking pin 80 protrudes into the cavity 26 in the locking latch 20.

The invention and the embodiments of the invention are not restricted to the examples shown in the figures. The invention may thus vary within the scope of protection afforded by the claims.

The invention claimed is:

1. A rotary handle construction of an electrical switch comprises:

a rotary handle being turnable around a first pivot axis between at least an open- and a closed-position, a locking latch being adapted into the rotary handle and being turnable around a second pivot axis between a locked-position and a released-position, a bottom ring being fixed in relation to the rotary handle, a first locking pin also being adapted into the rotary handle and being movable in the longitudinal direction with the locking latch between a first position and a second position, in which first position the first locking pin allows turning of the rotary handle in relation to the bottom ring and in which second position the first locking pin prevents turning of the rotary handle in relation to the bottom ring by protruding into a first opening in the bottom ring, a second locking pin has been adapted into the rotary handle, the second locking pin being movable in its longitudinal direction between a first position and a second position, in which first position the second locking pin allows turning of the locking latch between the locked-position and the released-position and in which second position the second locking pin prevents the locking latch to be turned into the locked-position.

2. The rotary handle construction according to claim 1, wherein the second locking pin is formed on a longitudinal pin extending in a longitudinal direction of the rotary handle.

3. The rotary handle construction according to claim 2, wherein the second locking pin comprises a first end and a second opposite end, wherein a lever arm has been arranged in connection with the second end, which lever arm is supported on the rotary handle via a pivot point, wherein turning of the lever arm around the pivot point moves the second locking pin in its longitudinal direction between the first position and the second position.

4. The rotary handle construction according to claim 3, wherein that the second end of the second locking pin seats, in the second position, in a cavity provided in the locking latch, wherein turning of the locking latch is prevented.

5. The rotary handle construction according to claim 4, wherein the lever arm protrudes out from the rotary handle so that when the user grabs the rotary handle, he simultaneously presses the lever arm into the rotary handle, wherein the second locking pin moves into its first position, in which the second locking pin prevents turning of the locking latch to the locked-position.

6. The rotary handle constructions according to claim 5, wherein a spring means is arranged in connection with the second locking pin and/or in connection with the lever arm, said spring means returning the second locking pin to the first position when the user releases his grip of the rotary handle.

7. The rotary handle construction according to claim 2, wherein that the second end of the second locking pin seats, in the second position, in a cavity provided in the locking latch, wherein turning of the locking latch is prevented.

8. The rotary handle construction according to claim 3, wherein the lever arm protrudes out from the rotary handle so that when the user grabs the rotary handle he simultaneously presses the lever arm into the rotary handle, wherein the second locking pin moves into its first position, in which the second locking pin prevents turning of the locking latch to the locked-position.

9. The rotary handle construction according to claim 7, wherein the lever arm protrudes out from the rotary handle so that when the user grabs the rotary handle he simultaneously presses the lever arm into the rotary handle, wherein the second locking pin moves into its first position, in which the second locking pin prevents turning of the locking latch to the locked-position.

10. The rotary handle constructions according to claim 3, wherein a spring means is arranged in connection with the second locking pin and/or in connection with the lever arm, said spring means returning the second locking pin to the first position when the user releases his grip of the rotary handle.

11. The rotary handle constructions according to claim 4, wherein a spring means is arranged in connection with the second locking pin and/or in connection with the lever arm, said spring means returning the second locking pin to the first position when the user releases his grip of the rotary handle.

12. The rotary handle constructions according to claim 7, wherein a spring means is arranged in connection with the second locking pin and/or in connection with the lever arm, said spring means returning the second locking pin to the first position when the user releases his grip of the rotary handle.

* * * * *